US008226317B2

(12) United States Patent
Uxa, Jr.

(10) Patent No.: US 8,226,317 B2
(45) Date of Patent: Jul. 24, 2012

(54) GEL SOAP DISPENSER

(76) Inventor: Frank J. Uxa, Jr., Mission Viejo, CA (US)

( * ) Notice: Subject to any disclaimer, the term of this patent is extended or adjusted under 35 U.S.C. 154(b) by 0 days.

(21) Appl. No.: 13/100,088

(22) Filed: May 3, 2011

(65) Prior Publication Data

US 2011/0268492 A1 Nov. 3, 2011

Related U.S. Application Data

(60) Provisional application No. 61/330,673, filed on May 3, 2010.

(51) Int. Cl.
*B43K 1/06* (2006.01)
*B43K 5/06* (2006.01)
*A46B 11/04* (2006.01)

(52) U.S. Cl. ..... 401/265; 401/263; 401/176; 401/179; 401/180; 401/270; 401/279; 401/205; 401/206

(58) Field of Classification Search ..... 401/158, 401/160, 162, 163, 263, 265, 176, 179, 180, 401/270, 279, 205, 206
See application file for complete search history.

(56) References Cited

U.S. PATENT DOCUMENTS

| | | | | |
|---|---|---|---|---|
| 995,769 | A * | 6/1911 | Coleman | 401/180 |
| 1,409,046 | A * | 3/1922 | Voltolini | 401/291 |
| 2,085,446 | A * | 6/1937 | Philippe | 222/386 |
| 3,214,783 | A * | 11/1965 | Perry et al. | 401/28 |
| 3,880,532 | A * | 4/1975 | O'Hare | 401/292 |
| 4,772,427 | A | 9/1988 | Dawson et al. | |
| 5,858,343 | A | 1/1999 | Szymczak | |
| 6,151,746 | A * | 11/2000 | Lewis, Jr. | 15/187 |
| 6,352,689 | B1 | 3/2002 | Szymczak | |
| 7,137,534 | B2 | 11/2006 | Patel | |
| 7,238,343 | B2 | 7/2007 | Lee et al. | |
| 7,375,640 | B1 | 5/2008 | Plost | |
| 7,485,609 | B2 | 2/2009 | Reddy et al. | |
| 7,540,397 | B2 | 6/2009 | Muderlak et al. | |
| 7,553,218 | B2 | 6/2009 | Morita | |
| 7,588,785 | B2 | 9/2009 | Evans | |
| 8,002,486 | B1 * | 8/2011 | Tran | 401/206 |

* cited by examiner

*Primary Examiner* — David Walczak
(74) *Attorney, Agent, or Firm* — Stout, Uxa, Buyan & Mullins; Frank J. Uxa

(57) ABSTRACT

Personal gel soap dispensers include a container, for example, having a size similar to a bar of hand soap or body soap, a quantity of gel soap in the container in an interior hollow space of the container, and at least one through opening, for example, a plurality of through openings extending from an interior hollow space of the container through the container.

20 Claims, 7 Drawing Sheets

GEL SOAP DISPENSER

RELATED APPLICATION

This application claims the benefit of U.S. Provisional Application Ser. No. 61/330,673, filed May 3, 2010, the disclosure of which Provisional Application is hereby incorporated herein in its entirety by reference.

FIELD OF INVENTION

The present invention relates to dispensers for gel soap. More particularly, the invention relates to personal gel soap dispensers, for example, useful for dispensing gel soap substantially immediately prior to using the gel soap for its intended purpose.

BACKGROUND OF THE INVENTION

Gel soaps, for example, in the form of body washes and the like, have become quite popular for use in showers, baths and the like. In general, gel soaps are sold in relatively large containers having a single opening through which the gel soap is dispensed for use. The container may be held in the hand of a human user so that separate increments or portions of the gel soap, e.g., body wash, can be dispensed as needed from the single opening in the larger container, for example, into the other hand or onto the body of the human user or onto a wash towel or other washing device used by the human user during showering/bathing. The large container may be picked up and set down several times during a shower/bath. This allows the human user of the large container to dispense portions of the gel soap, as desired, while also allowing the user to employ both hands to wash his/her body.

Using such a large, single opening container of gel soap can be inconvenient. For example, if the container is continuously held by the user, the hand holding the container cannot be used in washing one's body, thus making it more difficult and/or time consuming to effectively shower/bathe. If the container is periodically picked up and set down, the container can become slippery and difficult to handle. Such inconveniences can act as a deterrent to using gel soap for showering and bathing.

There is a need for new dispensers for gel soaps, for example, to facilitate the sale and/or use of gel soaps.

SUMMARY OF THE INVENTION

New dispensers for gel soaps, e.g., body washes and the like, have been discovered. The present dispensers, for example, personal gel soap dispensers, provide for effective and convenient, and even controlled, release of gel soap, for example, on demand or as desired by the user, without the need for holding a single opening large container of gel soap in one's hand or for repeatedly having to set down and pick up such a large container during use, for example, during taking a shower or bath. The present dispensers hold a supply of gel soap ready for use and may be useful and/or effective, for example, while being held in one hand of a human user, as a washing/cleaning implement during use, for example, during showering and/or bathing. The user of the present dispenser can dispense a quantity, for example, a controlled quantity, of gel soap from the dispenser while, at the same time, holding the dispenser, for example, in one hand, and using the dispenser as a washing/cleaning implement, for example, during showering and/or bathing. Thus, the user can obtain and enjoy the benefits of using a gel soap without the disadvantages of a relatively large, single opening gel soap container, for example, as set forth herein.

In one aspect, the present invention provides gel soap dispensers, for example, personal gel soap dispensers. Such dispensers may comprise a container defining an interior hollow space and at least one through opening, for example, a plurality of through openings, extending from the hollow space through the container. A quantity of gel soap may be located in the hollow space. The dispenser may include an assembly, e.g., a dispense or soap dispense assembly, coupled to the container and structured to be activated, for example, manually activated, to cause at least a portion of the gel soap in the hollow space to pass through the through opening or openings.

The container may have at least one through opening, for example, a plurality of through openings, from the hollow space through the container, for example, through the front sidewall portion of the container.

In one example, the container may have a size and/or shape substantially similar to that of a bar of hand soap or body soap, for example, an unused bar of hand soap or body soap, such as an unused full or regular sized bar of hand soap or body soap. The container may have a first end wall, a substantially opposing second end wall and a sidewall therebetween. In one embodiment, the sidewall of the container includes a first sidewall portion, a substantially opposing second sidewall portion, a front sidewall portion and a substantially opposing back sidewall portion.

In one example, the through opening or one or more or all of the plurality of through openings each has a closed position, for example, a resting or not-in-use position, effective to substantially prevent the gel soap in the interior hollow space from passing out of the through opening, and an opened position, for example, an activated or in-use position, effective to allow the gel soap in the interior hollow space to pass out of the through opening in response to activation of the dispenser assembly.

In one example, the dispenser may further comprise a valve or a plurality of valves, the valve or each of the valves being coupled to the through opening or one or more or all of the plurality of through openings, for example, such that each valve may be coupled to a different through opening. The valve or each of the valves is operable to move from a first position, for example, a closed valve position, effective to substantially prevent the gel soap in the interior hollow space from passing out of the through opening and a second position, for example, an opened valve position, to allow the gel soap in the interior hollow space to pass out of the through opening in response to activation of the dispense assembly.

The through opening or openings, valve or valves may be effective to regulate and/or control the dispensing of the gel soap from the dispenser.

In one example, the valve or valves may be provided so that the valve or valves do not substantially protrude or extend from the outer surface of the container. By not substantially protruding or extending from the outer surface of the container is meant that the valve or valves do not substantially disrupt the continuity of the outer surface of the container.

In one example, the present dispenser may be such that the first and second end walls of the container each may have an area in a range of about 2 square inches to about 8 square inches, and the first and second sidewall portions of the container may have an area in a range of about 1 square inch to about 10 square inches, and the front and back sidewall portions each may have an area in a range of about 4 square inches to about 12 square inches. Dispensers of other suitable sizes, shapes, contours and/or configurations may be used and are included within the scope of the present invention.

The dispenser may be sized to be held by one hand of an adult human.

In one example, the dispenser may be provided so that the container may have, either in part or substantially completely, an outer surface adapted to benefit the user of the dispenser, for example, to provide the user with a better grip of the dispenser while using the dispenser to provide the user with a more effective scrubbing surface, such better grip and more effective scrubbing surface each being relative to a smooth or completely smooth outer surface. The outer surface of the container may be provided, in whole or in part, with texturing, an abrasive surface, for example, a mild to moderately abrasive surface and/or one or more other surface features to provide one or more benefits to the user of the dispenser.

In one example, the gel soap dispenser further comprises one or more cleaning elements and/or scrubbing elements secured to the container, for example, to the outer surface of the container.

In one example, the container is structured to be refillable with gel soap.

The container may include a passageway or opening spaced apart from the through opening or plurality of through openings. The passageway is sized, for example, is larger than the through opening or each of the through openings, to allow gel soap from outside the container to be placed in the hollow space or interior hollow space of the container. In one example, the dispenser further comprises a cover to close the passageway. The cover may be coupled or uncoupled, e.g., not permanently attached, to the container.

The container may have one through opening or a plurality of through openings, for example, any suitable number of through openings. In one example, the container may have 2 to about 10 through openings. In another example, 2 to about 20 or more through openings may be employed.

The dispense assembly of the present personal gel soap dispenser may be of any structure useful and/or effective to be activated to cause gel soap from the interior hollow space of the container to pass through the through opening or plurality of through openings. For example, and without limitation, the dispense assembly may comprise a manually operable mechanism effective, when operated or activated, to pass an amount, for example, a desired amount and/or a controlled amount, of the gel soap from the interior hollow space through the through opening or plurality of through openings.

In one example, the dispense assembly may comprise a plunger element manually operable or activatable by a person holding the container to pass an amount of the gel soap from the hollow space through the through opening or through openings.

In one example, the dispense assembly may further comprise a movable inner wall, for example, a sealing inner wall member, located in the interior hollow space. The movable inner wall may have a first side and an opposing second side. The first side may define in part a first portion of the hollow space which holds a quantity of gel soap. The plunger element may be structured to be operable or activatable, for example, manually operable or activatable, between a first position in which a second portion of the hollow space defined by part of the second side of the inner wall is closed and a second position in which a fluid, for example, air, water and the like and combinations thereof, from outside the hollow space is allowed to enter the second portion of the hollow space. The movement of the plunger element between the first position and the second position is effective to reduce the size of the first portion of the hollow space and cause at least a portion of the gel soap in the hollow space to pass through the through opening or plurality of through openings. The movement of the plunger element from the first position and the second position may be effective to reduce the size of the first portion of the hollow space and further cause the through opening or plurality of through openings to move from a not-in-use, closed, resting position to an in-use, opened position and allow at least a portion of the gel soap in the hollow space to pass through the through opening or plurality of through openings and out of the dispenser.

In one example, the present dispensers further comprise one or more barrier elements over or in the through opening or openings. Such barrier element or elements may be effective to substantially prevent gel soap in the hollow space from passing through the through opening or openings, for example, prematurely or before such gel soap passing is desired. For example, such barrier element or elements may prevent leakage of the gel soap from the interior hollow space during transportation and/or storage of the present dispenser. When such gel soap passing is desired, the barrier element or elements can be removed. In one example, the barrier element or elements may be water soluble so that the barrier element or elements are dissolved in the shower/bath water or the like, in contact with the barrier element or elements, e.g., to allow the passing of the gel soap out of the dispenser.

In another aspect of the invention, a package assembly is provided. This package assembly may comprise a plurality of gel soap dispensers, as described elsewhere herein; and packaging holding, for example, surrounding and holding, the plurality of gel soap dispensers. Such packaging assembly is a very convenient and effective way to market the present gel soap dispensers. In one embodiment, the packaging employed, and the configuration of the gel soap dispensers in the package assembly may be similar to that used to package a plurality of bars of soap, e.g., hand soap or body soap, together.

Various embodiments of the present invention are described in detail in the detailed description and additional disclosure below. Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment of the present invention.

These and other aspects and advantages of the present invention are apparent in the following detailed description, claims and drawings in which like parts bear like reference numerals.

DETAILED DESCRIPTION

Figure 1:
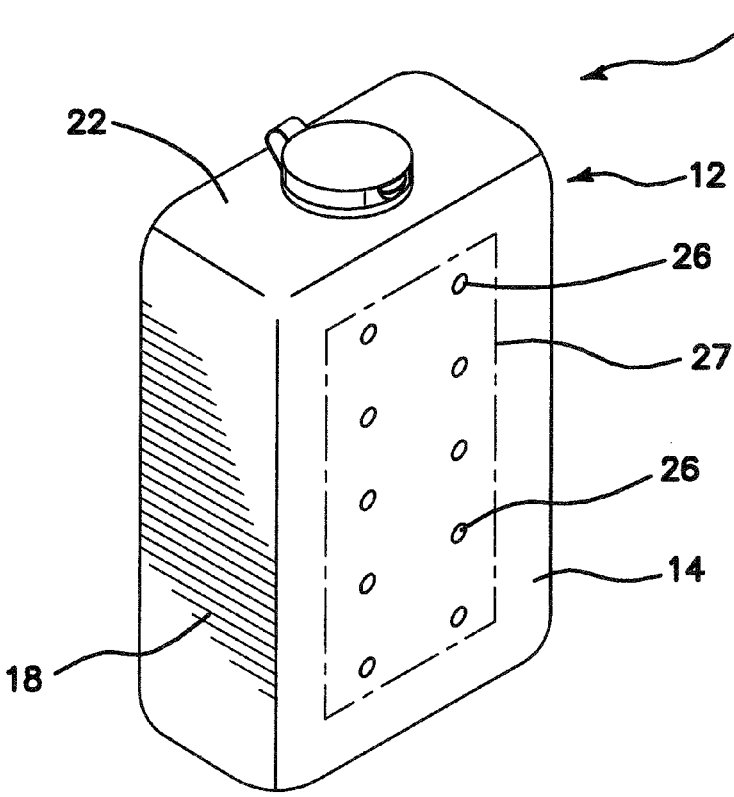
FIG. 1 is a front side view of a gel soap dispenser in accordance with the present invention.

The term "gel soap" as used herein refers to any liquid or gel soap composition which is sufficiently flowable and has a composition (chemical make-up) sufficiently effective to facilitate personal washing and/or cleaning and/or cleansing and/or hydrating and/or conditioning to be used in accordance with the present invention. The gel soap may have a viscosity which is greater or increased relative to liquid water at the same conditions. In one example, the gel soap may have a viscosity in a range of about 2000 Cp or less to about 20,000 Cp or more, or about 5000 Cp to about 15,000 Cp. Such viscosities may be measured at room temperature or about 25° C. The gel soap may include materials which enhance or facilitate foaming and/or lathering once the material is in use in washing and/or cleaning of a human or animal body or body part.

The gel soap useful in the present dispensers may be any such gel soap suitable for use therein. For example, such gel soap may contain water and/or one or more components, for example, without limitation, surfactants, effective to enhance the effectiveness of the gel soap, for example, in performing its function as a washing and/or cleaning and/or cleansing and/or hydrating and/or conditioning composition.

The surfactants used in the present gel soaps may be those surfactants that are generally known in the art for personal washing and/or cleaning and/or cleansing and/or the like uses, and are discussed in greater detail below.

Various components may be included to add functionalities to the present gel soaps. Non-limiting examples of components that may be included along with the surfactants are one or more therapeutic benefit agents, humectants, emollients, rheology (e.g., viscosity) modifiers, preservatives, fragrances, perfumes, colorants, antibacterial agents, exfoliating agents, anti-aging agents, whitening agent and the like and mixtures thereof. The various components of the gel soaps may be selected from materials which are conventionally used in gel soap formulations. The gel soap may be substantially clear or substantially opaque. In one embodiment of the gel soaps, foaming agents may be included to cause the soap to foam when the soap is passed through the through opening or openings of the container.

Surfactants, for example, those surfactants which may be identified as lathering surfactants, may be included to provide easy and rapid foam lather generation.

By a "lathering surfactant" is meant a surfactant, that when combined with water and mechanically agitated generates a foam or lather. These surfactants may be mild, for example, providing sufficient cleansing or detersive benefits without overly drying the skin or hair, e.g., without removing excessive amounts of natural oil and/or moisture.

The surfactant component of the gel soap may constitute about 5% to about 40%, or about 10% to about 25%, by weight of the total gel soap. The gel soap may include a relatively high concentration, for example, and without limitation, at least about 20% or at least about 30% or at least about 40% or at least about 50% or more by weight, of ingredients, for example, active ingredients, other than water. For example, the body wash may be a concentrated body wash, as that term is used in the art. Specific examples of concentrated gel soaps or body washes include, without limitation, Bliss Shock Therapy Super-Minty concentrated body wash, Sharps Barber Brigade Spearmint Jolt concentrated body wash, Amway concentrated Refreshing body wash, Whitening body wash, Satin Shower body wash, and the like concentrated body washes. The present dispensers may facilitate better, for example, more controlled and/or the like, dispensing of a highly concentrated gel soap relative to dispensing such gel soap from a container having a single opening.

A wide variety of lathering surfactants may be employed, including without limitation, those selected from anionic lathering surfactants, nonionic lather surfactants, amphoteric lathering surfactants, and the like and mixtures thereof. The lathering surfactant or surfactants may not strongly interfere with deposition of any skin care agent and/or conditioning agent that may be present. The lathering surfactant or surfactants may be water soluble and/or have an HLB value of about 10. Cationic surfactants can also be used as optional components, provided they do not substantially or significantly negatively impact the overall lathering ability characteristics of the gel soap. One or more co-surfactants may be present in the gel soap, for example, as stabilizers.

The gel soap may optionally contain a safe and effective amount of one or more therapeutic benefit agents, for example and without limitation, vitamin compounds, skin treating agents, anti-acne actives, anti-wrinkle actives, anti-skin atrophy actives, anti-inflammatory actives, topical anesthetics, artificial tanning actives and accelerators, anti-microbial actives, anti-fungal actives, sunscreen actives, anti-oxidants, skin exfoliating agents, and the like and combinations thereof.

As used herein, "a safe and effective amount" means an amount of a compound or component sufficient or high enough to at least significantly facilitate or induce or cause a positive effect or benefit, but low enough to avoid adverse, for example, significant adverse side effects, e.g., undue toxic, or other reaction, so as to provide a reasonable, for example, a reasonably favorable, benefit to risk ratio, within the scope of sound medical judgment. The amount of therapeutic benefit agent present in the gel soap may vary by the specific, individual agent, but all such agents, if present, may be present in an amount of about 0.01% or less to about 15% or more by weight of the gel soap.

These and other components which may be included in the gel soap are disclosed in Reddy et al U.S. Pat. No. 7,485,609. Other patents which may pertain to related subject matter include U.S. Patent Nos. 7,588,785, 7,553,218, 7,540,397, 7,485,609, 7,375,640, 7,238,343, 7,137,534, 6,352,689, 5,858,343 and 4,772,427. The contents of all of the patents identified herein are incorporated in their entireties herein by reference.

One specific gel soap useful in accordance with the present invention is Full Force™ Hydrating Wash (Dial° for Men), sold by the Dial Corporation, Scottsdale, Ariz. This product contains water, sodium laureth sulfate, cocamidopropyl betaine, PEG-8, sodium chloride, fragrance, glycerin, PPG-2 hydroxyethyl coco/isostearamide, cocamidopropyl PG-dimonium chloride, polyquaternium-10, polyquaternium-7, DM DM hydantoin, citric acid, tetrasodium EDTA, Blue 1 (CL42090), and Red 33 (CL17200).

Other commercially available compositions, and similar compositions, may be employed as the gel soap in the present dispensers.

Figure 4:
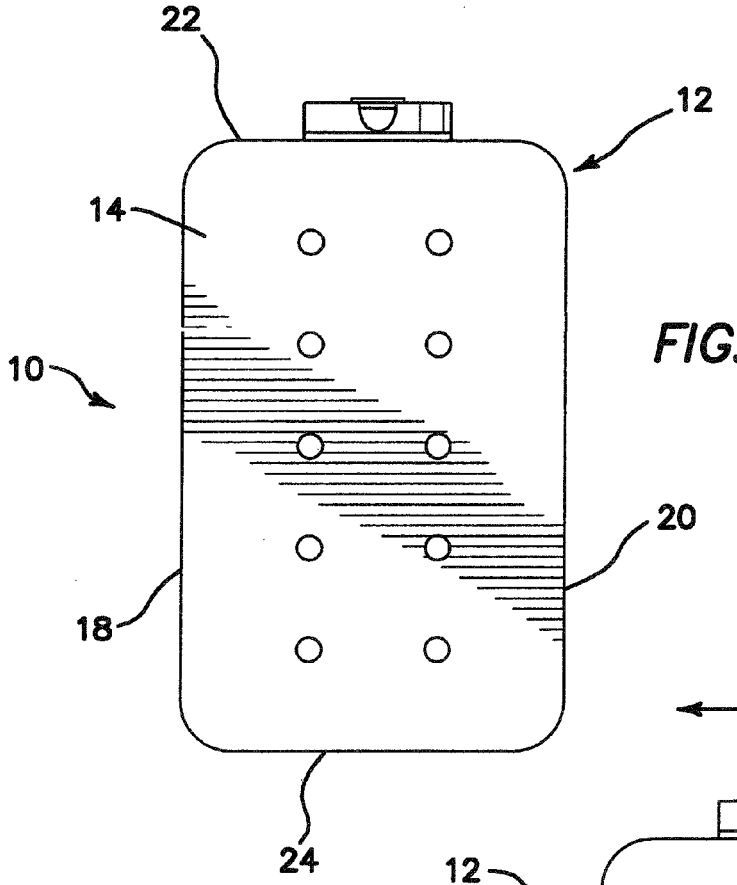
FIG. 4 is a front plan view of the gel soap dispenser shown in FIG. 1.
Figure 5:
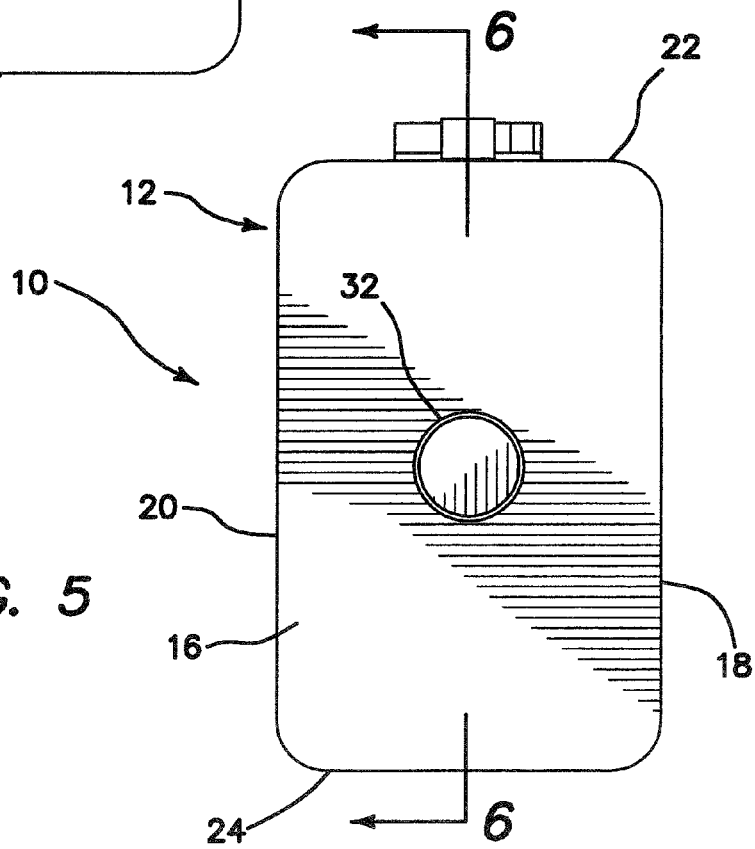
FIG. 5 is a backside plan view of the gel soap dispenser shown in FIG. 1.

Referring now to the drawings, and in particular to FIGS. 1, 4, 5, 6 and 7, a personal gel soap dispenser, shown generally at 10, includes a container 12, including a front sidewall portion 14, a back sidewall portion 16 (FIGS. 4 and 5), a first sidewall portion 18, a second sidewall portion (FIGS. 4 and 5), a top wall portion 22 and a bottom wall portion 24 (FIGS. 4 and 5).

Container 12 may be made of any suitable material, that is, any material that is suitable for use in the present gel soap dispenser.

In one example, the container 12 may be made of a polymeric material, for example, a thermoplastic polymeric material. Thermoplastic polymeric materials may include polymers comprising long, linear molecules, for example, having substantially little or substantially no crosslinking. Thermoplastic polymeric materials may become soft or even liquid when thermal energy (heat) is applied to them, and may be shapeable. When soft or molten, the thermoplastic polymeric materials may be processed, for example, by extrusion, molding, for example, injection molding, thermoforming, calendaring and the like. When the thermoplastic polymeric material has cooled, the material substantially maintains its given shape.

Examples of thermoplastic polymeric materials that may be used to make the gel soap dispensers of the present invention include, without limitation, polyolefins, fluorinated hydrocarbons, vinyl-polymers, acryl and methylacryl polymers, polyacetates and their copolymers, polyethers, polyesters, polyamides, polycarbonates, polysulfonates, polyurethanes and thermoplastic ethers of cellulose. Specific thermoplastic polymeric materials include polyethylene, polypropylene, polystyrene, polyethylene terephthalate (PET), acrylonitrile butadiene styrene (ABS) polymers, styrene acrylonitrile (SAN) polymers and the like and combinations thereof.

The material, e.g., polymeric material, from which the container 12 is made, may be insoluble in water and insoluble in the gel soap in the container, for example, container 12. Such material may be selected so as to have no significant adverse effect on the gel soap in the container as well as no significant adverse effect on the user of the dispenser 10, for example, the person using the dispenser 10 to dispense the gel soap. Polymeric materials which are known in the art to be used or useful in current large single opening gel soap containers may be employed in the gel soap dispensers in accordance with the present invention, for example, the gel soap dispenser 10.

The container 12 may be rigid or may be flexible or squeezable, such as manually squeezable, for example, at least to some extent. In one example, the container 12 may be such as to at least partially collapse, for example, upon being manually squeezed. Such partial collapse, which may be permanent, that is the container remains partially collapsed or may be temporary, that is the container returns to its original configuration after the collapsing force is removed, may be effective in passing gel soap from the hollow space formed in the container 12 through the through opening or plurality of through openings. In one example, the at least partially collapsible container is such that upon release of the squeezing force on the container, the container returns to substantially its original configuration.

The container 12 can be made using conventional techniques, for example, conventional polymer processing techniques, such as molding, for example, blow molding, injection molding and the like, extrusion, and the like and combinations thereof. In addition, the container 12 can be a unitary structure or can be made of individual parts which are secured, for example, using adhesives and/or heat and/or one or more other securing techniques, for example, and without limitation, conventional securing techniques, to form the container 12.

Figure 6:
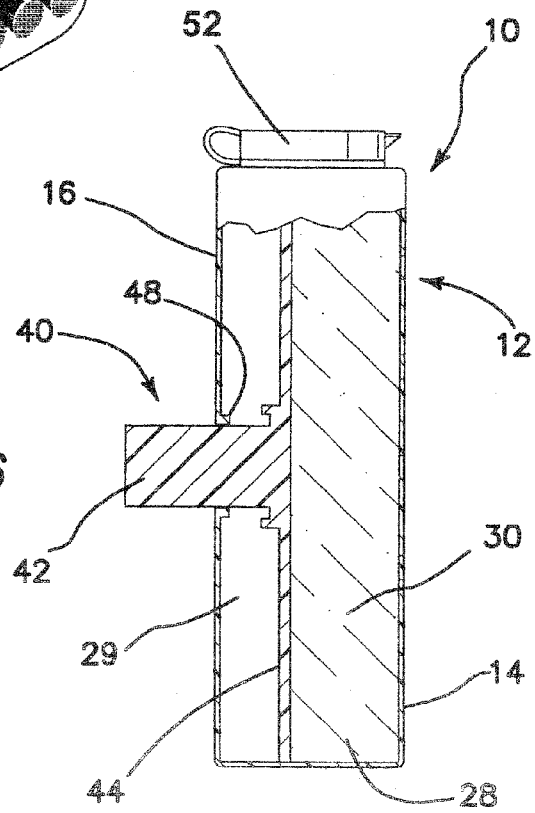
FIG. 6 is a cross-sectional view taken along line 6-6 of FIG. 5.

The front wall, or front sidewall, portion 14 of container 12 includes a plurality of through openings or holes 26 which extend from a hollow interior space 28 (FIG. 6) of container 12 through front wall portion 14. As shown in FIG. 6, the hollow interior space 28 includes a quantity of gel soap 30, for example, as described elsewhere herein. It should be noted that in some embodiments only one through hole or opening 26 is present and in some embodiments a plurality, i.e., 2 or more, through openings or holes 26 are present.

Figure 7:
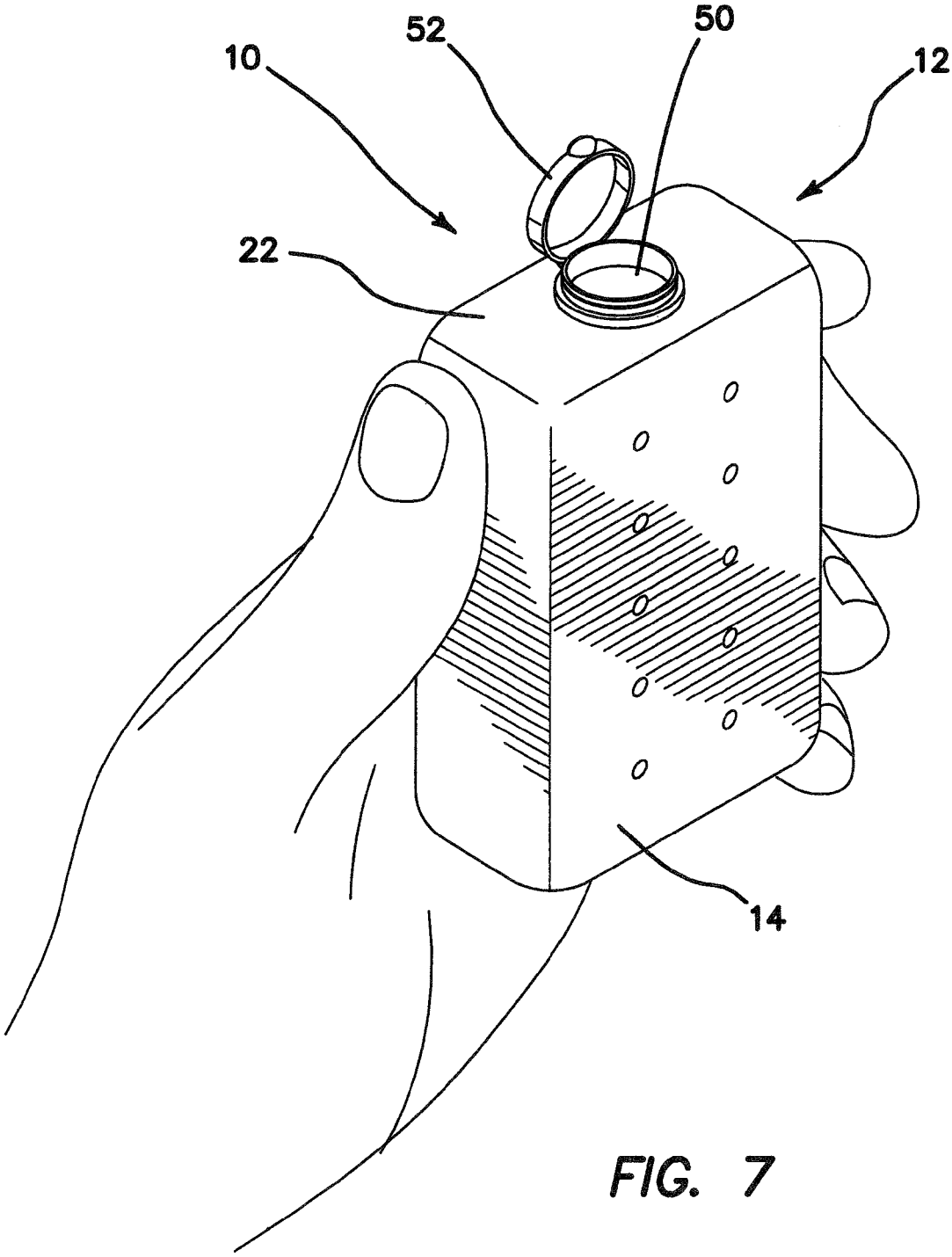
FIG. 7 is a perspective view showing the gel soap dispenser of FIG. 1 being held in a single hand of a human adult.

As shown in FIG. 7, gel soap dispenser 10 is sized and shaped to be conveniently held in one hand by an adult human. For example, gel soap dispenser 10 may be sized and shaped similarly to a bar of soap, e.g., a bar of hand soap or body soap, such as a bar of unused hand soap or body soap. One difference between the present gel soap dispenser and a conventional bar of soap is that the bar of soap, as it is used, becomes smaller and smaller, and becomes more difficult to handle as it becomes smaller. The present gel soap dispenser, on the other hand, may maintain its size and shape even after an extended period of use, thus providing that the present dispenser may be more easy to handle and use relative to a bar of soap.

The container 12 may have one or more wall portions, such as portions 14, 16, 18, 20, 22 and 24, which are substantially flat. In one embodiment, the container may have one or more such wall portions which are curved, for example and without limitation, concave, convex or a combination thereof, or otherwise contoured or curved, for example, to fit more effectively and/or more comfortably into a user's hand and/or to more effectively and/or more comfortably facilitate the use of the container in cleaning the user's body, for example, relative to a substantially identical container with all substantially flat wall portions.

As shown in FIG. 1, a barrier element 27 may be located on the front wall portion 14 over the through openings 26. Barrier element 27 is useful in preventing leakage of the gel soap 30 from interior hollow space 28 of container 12, for example, during transportation and storage of the unused dispenser 10. Barrier element 27, for example, a film of polymeric material, may be adhered to (using adhesive) the front wall portion 14 and may be removed from the front wall portion 14 prior to using the dispenser 10.

With particular reference to FIG. 6, dispenser 10 includes a gel soap dispense or dispensing assembly, generally referred to at 40. It should be noted that although a particular gel soap dispense assembly 40 is shown in FIG. 6, other assemblies or mechanisms can be used to perform the function or functions described herein with regard to gel soap dispense assembly 40. All such other assemblies and mechanisms are included within the scope of the present invention.

With regard to gel soap dispense assembly 40, a plunger element, for example, a push button 42 is secured to, for example, and without limitation, molded together with, a movable inner wall, for example, sealing member 44 as a unitary structure, or adhered to the sealing member 44, for example, using adhesives, or otherwise secured to the sealing member 44. The sealing member 44 is located in the interior hollow space 28 of container 12. By manually operating push button or plunger element 42, for example, by manually pushing push button 42 toward interior hollow space 28, one, for example, a human adult or user, can move sealing member 44 within the hollow interior space 28 toward front wall portion 14.

The sealing member 44 is structured to extend across substantially the entire interior hollow space 28 and to be effective in restricting or substantially preventing or even entirely preventing the flow of gel soap 30 across the sealing member, for example, into the other portion 29 of the interior hollow space 28 situated on the other side of the sealing member 44. In effect, sealing member 44 is movable between back wall portion 16 and front wall portion 14.

The sealing member 44 and/or push button 42 may be made of any suitable material or materials effective in allowing the dispense assembly 40 to function as described herein. In one embodiment, at least a portion, or even substantially all, of gel soap dispense assembly 40 is made up of one or more polymeric materials, for example and without limitation, as described elsewhere herein. The dispense assembly 40 may be made using conventional polymeric material processing. Other materials may be employed for the sealing member 44 and/or push button 42. In addition, push button 42 may be solid or hollow.

Push button 42 is positioned within opening 32 of the back wall portion 16 of container 12. In one embodiment, for example, as shown in FIG. 6, push button 42, in combination with sealing ring 48 located on the inner side of back wall portion 16, may substantially seal the space 29 from any substantial amount of liquid passing into space 29. In one embodiment, the relevant parts are sized so that such sealing does not occur, and water or other liquid can flow into space 29, for example, as sealing member is moved toward front wall portion 14.

As push button 42 is pushed, for example, manually pushed, into container 12, sealing member 44 is moved toward front wall portion 14. This movement causes a portion of the gel soap 30 in hollow space 28 to pass through the through openings 26. The portion of the gel soap 30 which passes through the through openings 26 is available for use in cleaning or washing, for example, the body of the adult human holding the gel soap dispenser 10 against or close to his/her body.

Gel soap dispenser 10 includes a relatively large opening 50, for example, located in the top wall portion 22. See FIG. 7. A lid or cover 52 may be provided, for example, coupled or attached to the container 12, and sized to cover and close opening 50.

Opening 50, which provides a passage through the top wall portion 22 into interior hollow space 28, can be used to refill interior hollow space 28 with gel soap. For example, when the supply of gel soap in interior hollow space 28 has been exhausted or is near exhaustion, the push button 42 can be retracted or withdrawn from the hollow interior space 28. This also moves sealing member 44 toward back wall portion 16. Water, or other liquid, that might have collected in region 29 of the hollow interior is removed as the sealing member is moved toward the back wall portion.

At this point, lid or cover 52 can be moved away to expose opening 50. A supply of gel soap, for example, a relatively large gel soap container having a single opening through which gel soap is passed, can be used to fill or refill the hollow interior space 28 with a quantity or supply of gel soap. Once such filling or refilling has been completed, the lid or cover 52 is again placed on opening 50 and the dispenser 10 is ready or again ready for use to dispense gel soap as needed, for example, by the adult human, using the gel soap dispenser 10.

Figure 2:
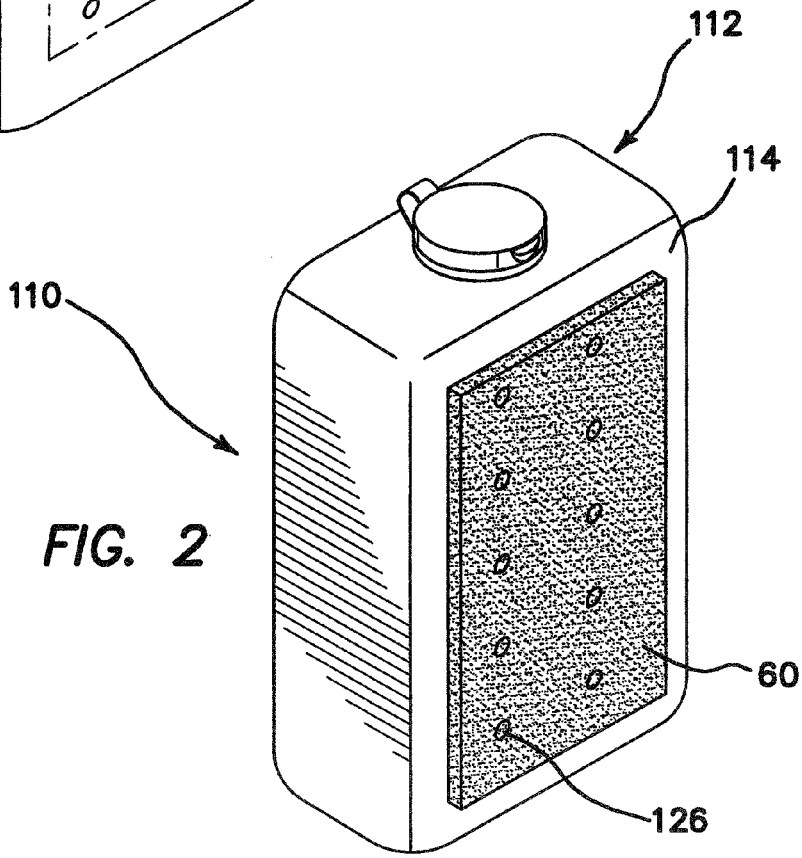
FIG. 2 is a front side view, in perspective, of an alternate embodiment of a gel soap dispenser in accordance with the present invention.

With reference now to FIG. 2, an alternate gel soap dispenser 110 is shown. Except as expressly described herein, dispenser 110 is structured and performs substantially similarly to that described with regard to dispenser 10. Components of dispenser 110 which correspond to components of dispenser 10 are indicated by the same reference numeral increased by 100.

The primary difference between dispenser 110 and dispenser 10 is the presence of a scrubbing element 60 located on the front surface 114 of container 112.

The scrubbing element 60 may be adhered (using adhesives) to the front surface portion 114 or may be comolded with the front surface portion 114 or may be otherwise secured to the front surface portion 114 of container 112, for example, using conventional techniques. Such securement should be sufficiently strong to withstand the action of washing and/or cleaning and/or scrubbing a human individual using the dispenser 110.

Any suitable scrubbing element 60 may be employed. Examples include terrycloth, luffa, foam, mesh and the like and combinations thereof. The scrubbing element 60 may be structured to allow the gel soap passing from the hollow interior space of container 112 through the through openings 126 to effectively contact the scrubbing element 60 and to be effective in performing its cleaning and/or washing and/or scrubbing function(s).

A removable barrier element (not shown in FIG. 2) can be placed over the scrubbing element 60 to prevent leakage of the gel soap from the container 112 during transportation and storage of dispenser 110. In one embodiment, the barrier element may include one or more plugs in or covering the through openings 126. Such plug or plugs may be made of a water soluble material, for example, a water soluble polymeric material, a wax material or the like. Upon being contacted with water, for example, in a shower or bath, the water soluble plug or plugs dissolve, allowing the gel soap in container 112 to be released or passed through through openings 126.

Figure 3:
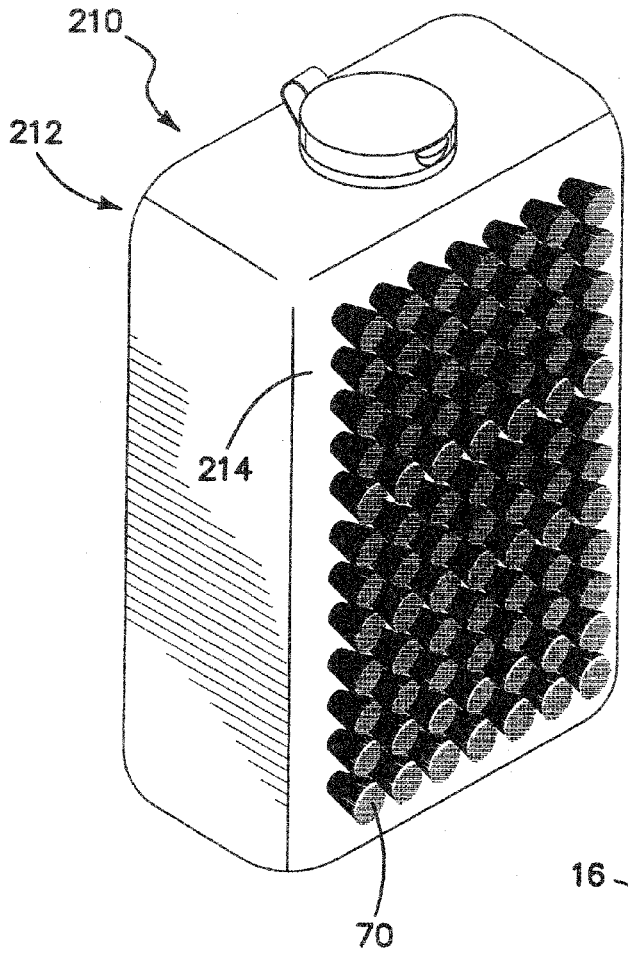
FIG. 3 is a front side view, in perspective, of an additional embodiment of a gel soap dispenser in accordance with the present invention.

FIG. 3 shows an additional embodiment of a gel soap dispenser, shown at 210, in accordance with the present invention. Except as expressly described herein, the gel soap dispenser 210 is structured and performs substantially similarly to gel soap dispenser 10. Components of gel soap dispenser 210 which correspond to components of gel soap dispenser 10 are indicated by the same reference numeral increased by 200.

The primary difference between gel soap dispenser 210 and gel soap dispenser 10 is the presence of a series of bristle or brush elements 70 located on the front surface portion 214 of container 212. The brush elements 70 can be adhered (using suitable adhesives) to front surface portion 214, comolded with front surface portion 214 or otherwise secured to the front surface portion 214 of container 212, for example, using conventional securement techniques.

The brush elements 70 are placed so that gel soap can pass from the interior hollow space of container 212 through the through openings (not shown in FIG. 3) in front surface portion 214 so that the gel soap can be used to perform its cleaning and/or washing and/or scrubbing function(s). The use of brush elements 70 can aid or facilitate such function or functions and, in addition, may provide some degree of therapeutic, for example, relaxing, effect to the human using the gel soap dispenser 210.

Figure 8A:
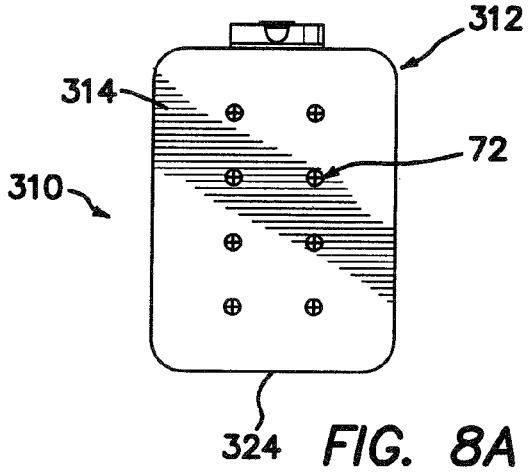
FIG. 8A is a front plan view of a further additional embodiment of a gel soap dispenser in accordance with the present invention.

FIG. 8A shows a further additional embodiment of a gel soap container, shown at 310, in accordance with the present invention. Except as expressly described herein, the gel soap dispenser 310 is structured and performs substantially similarly to gel soap dispenser 10. Components of gel soap dispenser 310 which correspond to components of gel soap dispenser 10 are indicated by the same reference numeral increased by 300.

The primary difference between gel soap dispenser 310 and gel soap dispenser 10 is that movable structures 72 are provided and cover (in the closed position shown in FIG. 8A) through openings 26 disposed on front wall 314. Movable structures 72 may be produced as an integral part of the container 312 or may be produced separately for the container and adhered or attached to the container, for example, using adhesive, heat sealing and the like conventional attachment/adhesion techniques. In one example, as shown in FIG. 8A, the structures 72 are located at the same regions where through holes 326 are located.

Figure 8B:
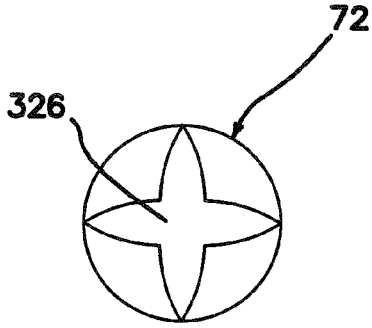
FIG. 8B is a detailed view of a through opening of the embodiment shown in FIG. 8A in an open position.

In this embodiment, when it is desired to dispense an amount of gel soap from container 312, the dispense assembly, such as the assembly shown in FIG. 6, is activated, for example, manually activated. This activation causes the gel soap in the hollow interior space of container 312 (similar to hollow interior space 28 in FIG. 6) to push against the movable structures 72 and move them from a resting, not-in-use, closed position, covering the through openings shown in FIG. 8A, into an in-use, opened position, in which through opening 326 is available to allow the passing of gel soap out of the hollow interior space, as shown in FIG. 8B. Gel soap is dispensed from the through openings 326, and is available for use in cleaning or washing, for example, the body of the adult human holding the gel soap dispenser 310 against or close to his/her body. Once the pressure on the gel soap is relieved, by the dispense assembly, the movable structures 72 move to the closed position and the flow of the gel soap from the hollow interior space stops.

With reference to FIGS. 8A and 8B, the structures 72 may either be integral with container 312, and therefore may be a part of a unitary structure, or may be individual parts that may be secured, for example, using adhesives and/or heat and/or one or more other securing techniques, e.g., conventional securing techniques, to form the container 312. In one example, the structures 72 may be individually secured to through openings 326. In one example, the structures 72 may be formed integrally with the front end or wall portion 314.

Figure 8C:
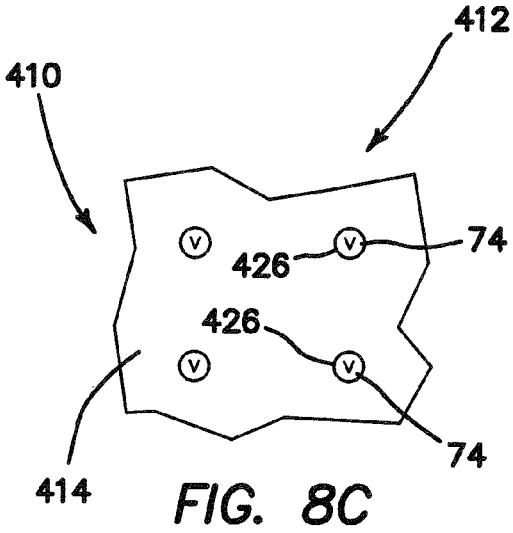
FIG. 8C is a somewhat schematic view of a further alternate embodiment of a gel soap dispenser in accordance with the present invention.

FIG. 8C is a somewhat schematic illustration of a segment of a further alternate gel soap dispenser 410. Except as expressly discussed herein, dispenser 410 is structured and functions (performs) substantially similarly to that described with regard to dispenser 10. Components of dispenser 410 which correspond to components of dispenser 10 are indicated by the same reference numerals increased by 400.

The primary difference between dispenser 410 and dispenser 10 is the presence of one way valves 74 positioned in or in proximity to through openings 426. One way valves 74 are effective in facilitating the control or in controlling the flow of gel soap from the hollow interior space of container 412 through the through openings 426 across the valves 74. The valves 74 may be effective to substantially prevent material, such as water, from entering the hollow interior space of the container 412 across the valves.

The valves 74 may be of any suitable construction. Two or more differently structured valves may be used in a single gel soap dispenser, for example, dispenser 410. Non-limiting examples of useful valves may include umbrella valves, duckbill valves, dome valves and the like and combinations thereof. The valves are made of a material that may be selected so as to have no significant adverse effect on the user of these dispensers, such as for example, dispenser 10. The valves may be made of polymeric materials which are known in the art to be used or useful for such valves.

Figure 9:
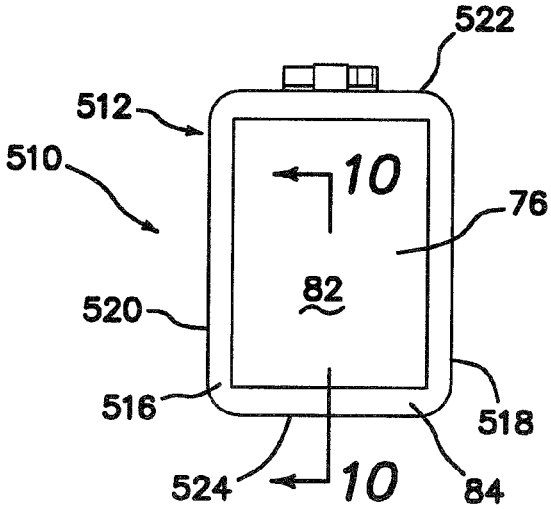
FIG. 9 is a back plan view of another embodiment of a gel soap dispenser in accordance with the present invention.
Figure 10:
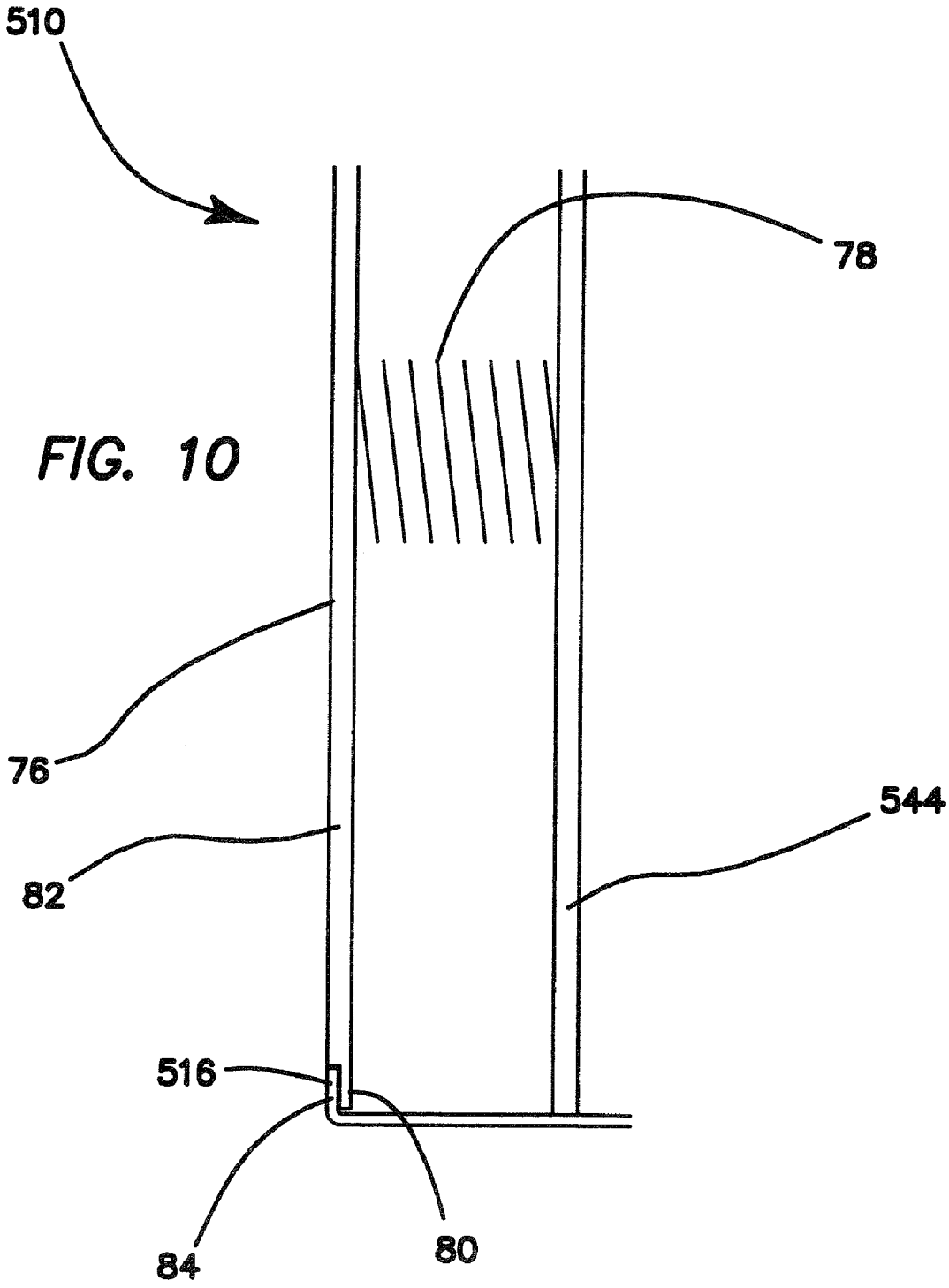
FIG. 10 is a partial cross-sectional view of the embodiment of the gel soap dispenser shown in FIG. 9

FIGS. 9 and 10 show another embodiment of a gel soap container, shown at 510, in accordance with the present invention. Except as expressly described herein, the gel soap dispenser 510 is structured and performs substantially similarly to gel soap dispenser 10. Components of gel soap dispenser 510 which correspond to components of gel soap dispenser 10 are indicated by the same reference numeral increased by 500.

The primary difference between gel soap dispenser 510 and gel soap dispenser 10 is that, instead of a push button 42 being secured as shown in FIG. 6, a push surface portion 76 is coupled to sealing member 544 by a biasing component or spring 78, which is secured to both push surface portion 76 and sealing member 544. For example, spring 78 can be comolded with sealing member 544 and/or push surface portion 76 or can be adhesively or otherwise secured or attached to sealing member 544 and/or push surface portion 76.

As shown best in FIG. 10, the outer edge 80 of push surface portion 76 is indented relative to the central region 82 of the push surface portion 76. The back wall portion 516 is abbreviated so as to form a restraining border, shown as 84 around the perimeter of the backside of the container 512. The combination of the restraining border 84 and indented outer edge 80 of the push surface portion 76 is effective in holding the push surface portion 76 to the remainder of the container 512.

The dispenser 510 functions as follows. At rest, spring 78 urges push surface portion into its most rearward position, as shown in FIG. 10, with the outer edge 80 of the push surface portion 76 in contact with restraining border 84. When it is desired to dispense gel soap from dispenser 510, a human user pushes central region 82 of push surface portion 76 inwardly overcoming the force of the spring 78 and pushing sealing member 544 toward the through openings (not shown in FIGS. 9 and 10), such as through openings 26 in FIG. 1. Continued pushing of the central region 82 forward, toward the through openings of dispenser 510, results in an amount of gel soap being dispensed from the hollow interior space of the dispenser 510 through the through openings. Once the desired amount of gel soap has been dispensed, the manual pushing force on the central region 82 of push surface portion 76 is withdrawn or released and the spring 78 urges the push surface portion back to its rearward most position, as shown in FIG. 10.

In one example, the sealing member, such as member 544, may not be included. In this example, the spring 78 may extend between, for example, and be secured or attached to both, the push surface portion 76 and the front surface portion of the container 512. The size, shape and/or configuration of the push surface portion 76 may be sufficient or effective, for example, relative to the remainder of container 512, so that the gel soap in the hollow interior space is substantially prevented from passing out of the container 512 across the push surface portion 76. In this embodiment, push surface portion 76 may be considered a barrier or sealing element.

With reference to FIG. 9, push surface portion 76 may be made of any suitable material or materials effective in facilitating the effective functioning of the dispenser 510, for example, as described herein. For example, the push surface portion 76 and the spring 78 may be made of any suitable material or materials of construction, and combinations thereof, for example, and without limitation, as described elsewhere herein. In one example, the spring 78 may be made of one or more metals, the push surface portion 76 may be made of one or more polymeric materials, for example, one or more thermalplastic polymeric materials, for example, as described elsewhere herein.

The present containers may be manufactured using a suitable manufacturing technique or combination of manufacturing techniques, for example, any suitable conventional polymeric material processing techniques, such as, without limitation, molding and the like, for example, as described elsewhere herein.

Figure 11:
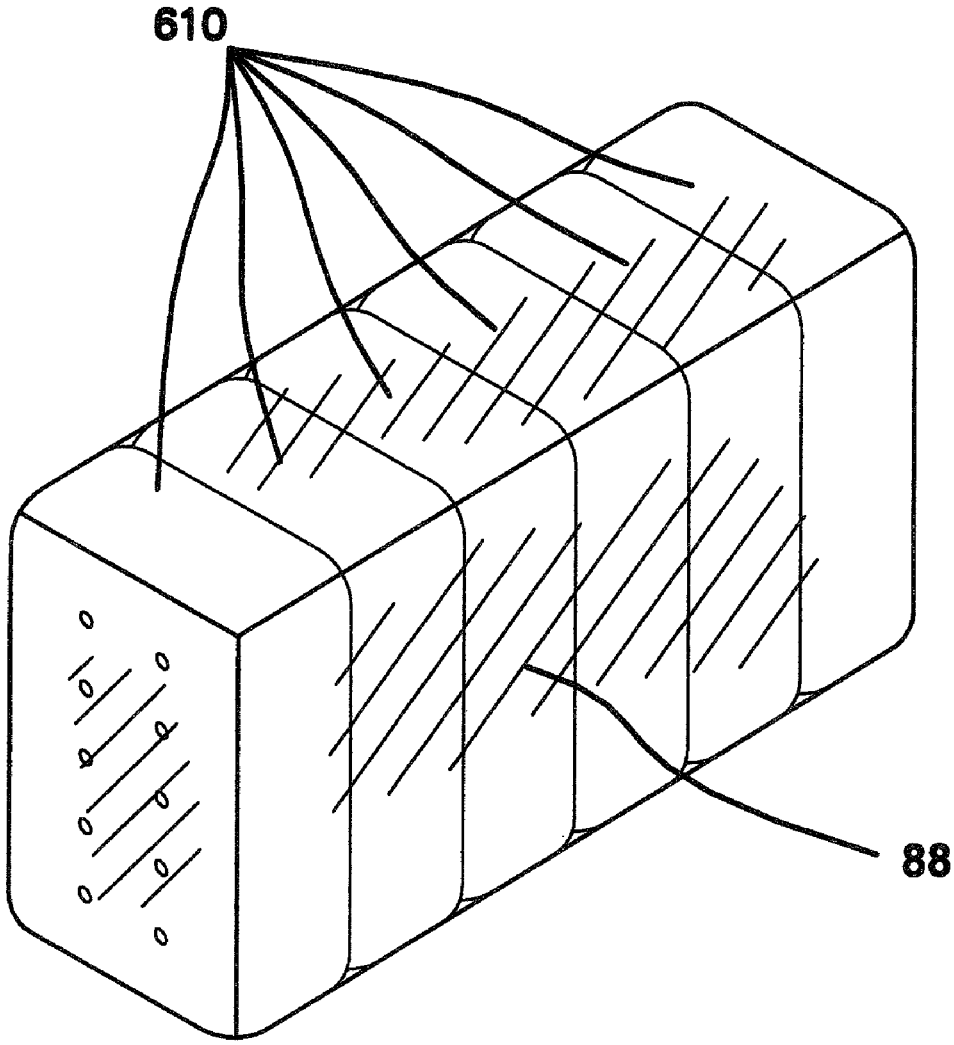
FIG. 11 is a perspective view showing a package including a plurality of gel soap dispensers in accordance with the present invention.

FIG. 11 shows a package assembly in accordance with the present invention. In particular, a packaging film or sheet material 88, for example, a conventional clear (transparent) polymeric material, is shown substantially surrounding a series of six (6) gel soap dispensers 610. Except as expressly described herein, each of the gel soap dispensers 610 is structured and functions substantially similarly to that described with regard to gel soap dispenser 10. Components of dispenser 610 which correspond to components of dispenser 10 are indicated by the same reference numeral increased by 600.

The primary difference between the gel soap dispensers 610 and gel soap dispenser 10 is that the gel soap dispensers 610 do not include an opening, such as opening 50, or a cap, such as cap 52, as in gel soap dispenser 10.

A supply of gel soap is included (during production of the gel soap dispensers 610) in the interior hollow space of each of the individual gel soap dispensers 610. Thus, there is no need to fill and refill the dispensers 610 with gel soap. It should be noted that one or more or even all, of the gel soap dispensers 610 can include an opening and cover, such as opening and cover 52 in gel soap dispenser 10. The gel soap dispensers 610 can be sold together in packaging 80, much like packages including a plurality of bars of hand soap and body soap are sold. Individual gel soap dispensers 610 can be removed, one by one, from packaging 80 and used as needed.

Any one of the gel soap dispensers disclosed herein, for example, gel soap dispensers 10, 110, 210, 310, and 410, as well as gel soap dispenser 610, can be packaged as shown in FIG. 11 and sold. Also, individual gel soap dispensers, such as gel soap dispensers 10, 110, 210,310, 410, 510 and 610 in accordance with the present invention may be individually packaged and sold.

The present gel soap dispensers may be provided without the gel soap in the hollow interior space. Thus, in order to use such a gel soap dispenser, the gel soap is added into the hollow interior space, for example, through an opening, such as opening 50 in gel soap dispenser 10, prior to use of the gel soap dispenser.

The present personal gel soap dispensers can be used very easily and effectively in methods to wash and/or clean and/or cleanse and/or scrub a human user. For example, with the gel soap dispenser held in a hand of a human, e.g., adult human, user, and the front sidewall portion facing outward from the palm of the hand, the user can, by pushing (using the same hand holding the gel soap dispenser to push) the push button in toward the front sidewall portion, cause gel soap from the container to pass through the through opening or openings and out of the container. The gel soap is then available to be applied to the body of the user, for example, by placing the container, in particular the front sidewall portion of the container, close to or, in contact with the part of the user's body desired to be cleaned. The user can then use the container of the gel soap container in much the same way as he/she would use a bar of soap, e.g., a bar of hand soap or a bar of body soap, to clean that portion of his/her body. This process can be repeated until the desired cleaning of the user's body or portion thereof, is completed. Also, if desired, a separate cleaning device, such as a wash towel, scrubbing element and the like, can be used. For example, the gel soap from the container can be placed on the wash towel, scrubbing element and the like, rather than being placed directly on the body of the user.

In any event, the present personal gel soap dispensers provide for easy, convenient and advantageous use of gel soaps, for example, without the disadvantages of large, single opening gel soap containers, as discussed elsewhere herein.

While this invention has been described with respect to various specific examples and embodiments, it is to be understood that the invention is not limited thereto and that it can be variously practiced within the scope of the following claims.

What is claimed is:

1. A personal gel soap dispenser comprising:

a container having a first end wall, a substantially opposing bottom wall and a sidewall therebetween, the sidewall including a front sidewall and a back sidewall, the container having an interior hollow space between the top and bottom walls and the sidewall and a plurality of through openings from the interior hollow space through the container to outside the container, the container has at least one of a size and a shape substantially similar to a bar of hand soap or substantially similar to a bar of body soap;

a quantity of gel soap located in the interior hollow space; and a dispense assembly coupled to the container and structured to be activated to cause at least a portion of the gel soap in the interior hollow space to pass out of the interior hollow space through the plurality of through openings, wherein the dispense assembly comprises a movable inner wall located between and separate from the front sidewall and the pack sidewall, the movable inner wall being movable between a first position in which the movable inner wall is located spaced apart from the plurality of through openings and does not urge the gel soap in the interior hollow space to pass out of the interior hollow space through the plurality of through openings, and a second position in which the movable inner wall is located closer to the plurality of through openings than with the movable inner wall in the first position, and at least a portion of the gel soap in the interior hollow space is passed out of the interior hollow space through the plurality of through openings.

2. The dispenser of claim 1, wherein the plurality of through openings extend from the interior hollow space through the front sidewall.

3. The dispenser of claim 1, wherein the container has a size substantially similar to a bar of hand soap or substantially similar to a bar of body soap.

4. The dispenser of claim 1, wherein the dispense assembly comprises a manually operable mechanism.

5. The dispenser of claim 4, wherein the mechanism comprises a plunger element positioned to be pushed by a human holding the container to move the movable inner wall to the second position.

6. The dispenser of claim 5, wherein the movable inner wall is operatively coupled to the plunger element, the movable inner wall having a first side and an opposing second side, the first side defining a first portion of the interior hollow space which holds the quantity of gel soap, the plunger element being operable to move the movable inner wall to reduce the size of the first portion of the hollow space, and cause at least a portion of the gel soap in the interior hollow space to pass out of the interior hollow space through the plurality of through openings.

7. The dispenser of claim 1, wherein the dispense assembly includes a biasing component operatively coupled to the movable inner wall, and being effective to move the movable inner wall from the second position to the first position.

8. The dispenser of claim 1 wherein the dispense assembly includes a biasing component operatively coupled to the movable inner wall, the movable inner wall being manually movable from the first position to the second position, and being movable by the biasing component from the second position to the first position.

9. The dispenser of claim 1, wherein each of the plurality of through openings has a closed position effective to substantially prevent the gel soap in the interior hollow space from passing out of the through opening and an opened position effective to allow the gel soap in the interior hollow space to pass out of the through opening in response to activation of the dispense assembly.

10. The dispenser of claim 1, which further comprises a plurality of valves, each valve being coupled to a different through opening of the plurality of through openings, each of the valves being operable to move from a first valve position effective to substantially prevent the gel soap in the interior hollow space from passing out of the coupled through opening and a second valve position effective to allow the gel soap in the interior hollow space to pass out of the coupled through opening in response to activation of the dispenser assembly.

11. The dispenser claim 1, wherein the container is refillable with gel soap.

12. The dispenser of claim 11, wherein the container includes a passageway spaced apart from the plurality of through openings, the passageway being sized to allow gel soap from outside the container to be placed in the interior hollow space.

13. The dispenser of claim 1 which further comprises a scrubbing element secured to the container, and located outside the interior hollow space.

14. The dispenser of claim 1, wherein the container has 2 to about 10 of the through openings.

15. The dispenser of claim 1 which further comprises one or more removable barrier elements located over or in the plurality of through openings, and effective to prevent the gel soap in the hollow space from passing through the plurality of through openings.

16. A package assembly comprising a plurality of personal gel soap dispensers of claim 1; and packaging holding the plurality of personal gel soap containers.

17. A personal gel soap dispenser comprising:

a container having a top wall, a substantially opposing bottom wall and a sidewall therebetween, the container having an interior hollow space and a plurality of through openings from the interior hollow space through the container to outside the container;

a quantity of gel soap located in the interior hollow space; and a dispense assembly coupled to the container and structured to be activated to cause at least a portion of the gel soap in the interior hollow space to pass through the plurality of through openings to outside the container, wherein the dispense assembly comprises a movable inner wall operatively coupled to the container and located within the interior hollow space, and a biasing component operatively coupled to the movable inner wall, the movable inner wall being movable between a first position in which the gel soap in the hollow interior space does not pass through the plurality of through openings, and a second position in which at least a portion of the gel soap in the hollow interior space passes through the plurality of through openings, the movable inner wall is movable by the biasing component from the second position to the first position.

18. The dispenser of claim 17, which further comprises a plurality of valves, each valve being operatively coupled to a different through opening of the plurality of through openings, each of the valves being operable to move from a first valve position effective to substantially prevent the gel soap in the interior hollow space from passing through the through opening to which the valve is coupled and a second position effective to allow the gel soap in the interior hollow space to pass through the through opening to which the valve is coupled in response to activation of the dispenser assembly.

19. The dispenser of claim 17 which further comprises a scrubbing element secured to the container and extending out of the container.

20. The dispenser of claim 17, wherein the container has a size substantially similar to a bar of hand soap or substantially similar to a bar of body soap.

* * * * *